US005480142A

United States Patent [19]

Ackerman

[11] Patent Number: 5,480,142

[45] Date of Patent: Jan. 2, 1996

[54] REVERSIBLY ELEVATABLE GOLF CUP

[76] Inventor: Vojtech Ackerman, 4958 Dumfries Dr., Houston, Tex. 77096

[21] Appl. No.: 411,108

[22] Filed: Mar. 27, 1995

[51] Int. Cl.[6] ..... A63B 57/00

[52] U.S. Cl. ..... 273/34 A

[58] Field of Search ..... 273/34 R, 34 A, 273/34 B, 179 R, 179 A, 179 B, 179 D

[56] References Cited

U.S. PATENT DOCUMENTS 1,470,603 10/1923 Du Bois ..... 273/34 A 2,721,723 10/1955 Ciambriello et al. ..... 273/34 A X

*Primary Examiner*—George J. Marlo

*Attorney, Agent, or Firm*—Benjamin A. Adler

[57] ABSTRACT

The present invention provides a modified golf cup comprising: a golf cup; and means for reversibly elevating said cup in response to a golf ball entering said cup. In a preferred embodiment, the modified golf cup has a power-driven lifting means for reversibly elevating said cup.

7 Claims, 1 Drawing Sheet

REVERSIBLY ELEVATABLE GOLF CUP

BACKGROUND OF THE INVENTION

1. Field of the Invention

The present invention relates generally to the field of a modified golf cup. More specifically, the present invention relates to a golf cup modified to provide a power source to automatically elevate a golf cup upon impact of a golf ball landing into the cup.

2. Description of the Related Art

Golf cups are well known and have had various construction while maintaining a basic form in order to meet standard rules within golfing associations. In the past, golf cups have been primarily used to hold golf balls, which pass into them at the completion of a successful putt or stroke, and to support the flag which marks the hole. These cups are inserted into a round cylindrical opening in the green and are recessed below the level of the green according to the Professional Golf Association's guidelines and contain holes in the bottom of the cup to facilitate drainage of water. Prior modifications to golf cups have generally served the purposes of diminishing the size of the available opening to serve as a training aid for putting. Other modifications have improved the ability of the cup to support and hold the flag without tilting.

Yet other modifications have been made to link advertisements to golf equipment. For example, U.S. Pat. No. 4,928,417 to Boudreau disclosed a doughnut-shaped insert that contains an advertisement which fit or snap into any conventional golf cup. This invention did not modify the golf cup but attaches the doughnut-shaped insert by means of prongs into the existing drainage holes of the conventional golf cup or places the insert (without prongs) directly onto the portion of the cup which contains the drainage holes and forces the drainage water to pass through the slight opening at the perimeter of the insert. This invention relies on the placement of a rigid insert into a conventional golf cup and sacrifices the drainage openings to provide a means to hold or support the insert.

U.S. Pat. No. 3,511,501 to Sandberg discloses a golf cup adapted to be concealed when not in use. An inner receptacle, sized to snugly fit within the golf cup, is filled with growing lawn grass so that the golf cup is substantially concealed when the inner receptacle is inserted into the cup.

U.S. Pat. No. 4,900,023 to Gelina provides a golf cup insert which can be easily frictionally engaged to provide for variation in the effective size of the golf cup. This invention is an aid for increasing a golfer's skill in putting by varying the size of the receptacle to sizes smaller than normal thereby increasing the putting accuracy which must be developed.

U.S. Pat. No. 5,078,394 to Kretz also discloses a putting skill improvement device having a simulated putting green grass surface and a special lip design to insure the cup opening is level with the putting surface.

U.S. Pat. No. 5,351,950 discloses a substantially non-metallic golf cup which provides a metallic sound indicating that a golf ball has dropped into the cup. A non-metallic carriage having a metallic portion is suspended above a metallic plate. A golf ball dropping into the cup forces the carriage to be displaced causing the carriage metallic portion to make contact with the metallic plate thus producing the metallic sound. A transparent cover on the carriage is hermetically sealed to protect advertising material contained within the cover for viewing when approaching the golf cup.

U.S. Pat. No. 4,290,603 discloses a ball-ejecting golf cup in which a golf ball comes to rest; on a vertical plunger disposed within the cup to traverse a sealed chamber, the plunger being spring biased in an upward direction. The ball and plunger are depressible by the golfer with any suitable tool, such as the handle of the putter. Also included was a device for retaining the plunger depressed for a short time, allowing the putter to be removed, and then to release the plunger to snap upwardly to eject the ball upwardly to a height convenient for the golfer to catch it. Finally, a mechanism was provided for adjusting both the time delay before the ball is ejected and also the height to which the ball is ejected.

The prior art is deficient in the lack of effective means of facilitating the game of golf by providing a modified golf cup which simplifies the retrieval of a golf ball from the golf cup. The present invention fulfills this longstanding need and desire in the art.

SUMMARY OF THE INVENTION

In one embodiment of the present invention, there is provided a modified golf cup, comprising: a golf cup; and means for reversibly elevating said cup.

Generally, the means for reversibly elevating said cup is any power-driven lifting means. Preferably, the power-driven lifting means is a power antenna. Most preferably, the power antenna is a telescoping power antenna.

Generally, in the modified golf cup of the present invention, the means for reversibly elevating said cup is activated by a golf ball contacting an electric pressure switch on said cup. Further, the cup after elevation is retracted back into a golf hole after the golf ball is removed from the cup. Preferably, the modified golf cup of the present invention is elevated to a predetermined height. Most preferably, the cup is elevated to a height of about 30 inches.

Other and further aspects, features, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others which will become clear, are attained and can be understood in detail, more particular descriptions of the invention briefly summarized above may be had by reference to certain embodiments thereof which are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

The present invention is directed to a golf cup modified to have a lifting device which propels the cup out of the golf hole subsequent to the ball landing in the cup. In a preferred embodiment, the lifting device resembles an automobile automatic antenna. Thus, the lifting device consists of a small DC (AC) electrical motor and drive assembly. They are fed either locally via, if its in a self-contained can battery or centrally from battery, AC system or uninterruptible power source (UPS) system (if it's part of a golf range or training center. The motor is connected to the antenna stationary tube which is covering the antenna mast. A ball holder and a small contact or pressure switch are located on top of the antenna mast. In this embodiment of the present invention, the lifting system is mounted as part of the can under the golf hole. When a balls falls in the hole and into the ball holder, the golf ball hits the pressure switch or contact. When the golf ball hits the switch or contact (the electrical circuit is closed), the lifting device immediately activates and elevates the golf ball to the predetermined height determined according the manufacturer's specifications for that particular power antenna.

A preferred embodiment of the lifting device is a telescoping power antenna which extends and retracts by a reversible electric motor. The antenna is controlled by an external relay and automatic limiting switches built into the electric motor housing. The electric motor extends the antenna mast to maximum length and then is declutched by the limiting switches. The antenna automatically raises when a golf ball falls into the golf cup contacting the pressure switch. The antenna automatically retracts upon removing the golf ball from the golf cup. The placement of the switch is such that the switch is basically in the middle of the cup so that the ball rests completely on the switch until the ball is removed.

The following is given for the purpose of illustrating various embodiments of the invention and are not meant to limit the present invention in any fashion.

Figure 1:
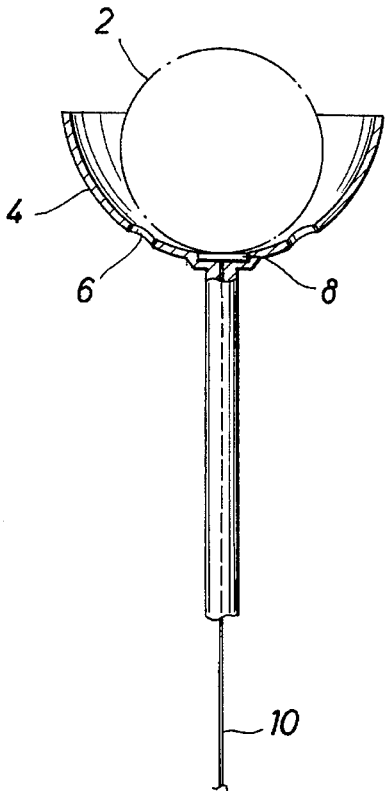
FIG. 1 shows a schematic of the ball holder having a pressure switch.

With reference to FIG. 1, golf ball 2 is shown as placed in golf holder or cup 4. Like most golf cups, the modified golf cup of the present invention would have at least one drainage hole 6. The modified golf holder or cup 4 has a electric pressure switch 8 located near the base of the cup 4. The embodiment of the modified golf cup of the present invention shown in FIG. 1 illustrates a wire 10 from the pressure switch to the power source.

Figure 2:
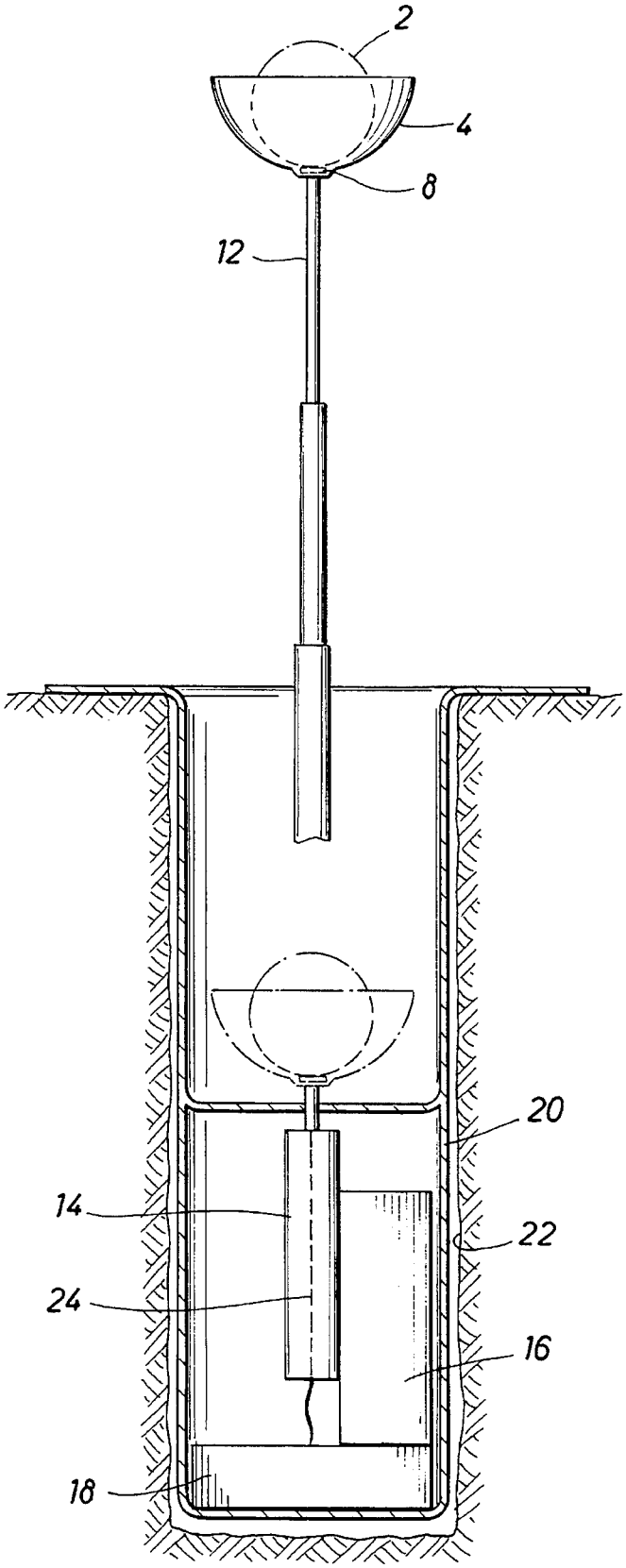
FIG. 2 shows a schematic view of the modified golf cup with the pressure switch in a retracted and elevated position.

FIG. 2 illustrates an embodiment of the present invention in both the elevated and recessed positions. A golf ball 2 is shown as placed in golf holder or cup 4. Attached to the golf holder or cup 4 is an antenna mast 12 which arises out of stationary tube 14. The modified golf holder or cup 4 has a electric pressure switch 8. The stationary tube 14 is connected to an electric motor 16 having a standard power source 18. The entire power driven modified golf cup and apparatus is housed in a can 20 placed into a hole 22 in the ground. A wire 20 connects the pressure switch to the electric power source.

Any patents or publications mentioned in this specification are indicative of the levels of those skilled in the art to which the invention pertains. These patents and publications are herein incorporated by reference to the same extent as if each individual publication was specifically and individually indicated to be incorporated by reference.

One skilled in the art will readily appreciate that the present invention is well adapted to carry out the objects and obtain the ends and advantages mentioned, as well as those inherent therein. The present examples along with the methods, procedures, treatments, molecules, and specific compounds described herein are presently representative of preferred embodiments, are exemplary, and are not intended as limitations on the scope of the invention. Changes therein and other uses will occur to those skilled in the art which are encompassed within the spirit of the invention as defined by the scope of the claims.

What is claimed is:

1. A golf cup, comprising:

a golf cup adapted to be placed in a hole in a golf green; and means for reversibly elevating said cup a predetermined distance above said green in response to a golf ball entering said cup.

2. The golf cup of claim 1, wherein said means for reversibly elevating said cup is a power-driven lifting means.

3. The golf cup of claim 2, wherein said power-driven lifting means is a power antenna.

4. The golf cup of claim 3, wherein said power antenna is a telescoping power antenna.

5. The golf cup of claim 1, wherein said means for reversibly elevating said cup is activated by a golf ball contacting an electric switch on said cup.

6. The golf cup of claim 5, wherein said electric switch is an electric pressure switch.

7. The golf cup of claim 1 wherein said predetermined distance is about 30 inches.

* * * * *